United States Patent [19]

Beckett, deceased et al.

[11] Patent Number: 4,872,275

[45] Date of Patent: Oct. 10, 1989

[54] DITCH CLEANING MACHINE

[76] Inventors: Orval D. Beckett, deceased, late of Placerville; by Berta M. Beckett, legal representative, 4125 McHenry Ave. - Space 121, Modesto, both of Calif. 95350

[21] Appl. No.: 196,648

[22] Filed: May 20, 1988

[51] Int. Cl.[4] ..... E02F 5/02

[52] U.S. Cl. ..... 37/91; 15/3; 15/93 B; 37/190; 56/249

[58] Field of Search ..... 37/82, 91, 93, 190; 15/93 B, 3; 56/15.2, 249, 255, 256

[56] References Cited

U.S. PATENT DOCUMENTS

| | | | |
|---|---|---|---|
| 606,987 | 7/1898 | Clark | 37/82 |
| 799,753 | 9/1905 | O'Connor | 37/82 |
| 3,646,733 | 3/1972 | Clapsaddle, Jr. | 56/15.2 X |
| 4,109,336 | 8/1978 | Ford | 15/93 B X |
| 4,494,365 | 1/1985 | Lloyd | 56/256 |

FOREIGN PATENT DOCUMENTS

| | | | |
|---|---|---|---|
| 264230 | 10/1949 | Switzerland | 37/82 |
| 1175372 | 8/1985 | U.S.S.R. | 37/82 |

*Primary Examiner*—Edgar S. Burr
*Assistant Examiner*—Moshe I. Cohen
*Attorney, Agent, or Firm*—Lothrop & West

[57] ABSTRACT

A ditch cleaning machine is for a longitudinally extending ditch having in a vertical trapezoidal transverse cross-section a greater width at the top than at the bottom and having slanting side walls. The machine has a steerable main frame ground-supported and engine-driven to advance along the ditch. The two-wheel main frame is laterally stabilized by adjustable outrigger wheels. A pair of cleaning rotors is pivoted to the main frame and to the forward end of a longitudinal elevator trough so as to engage the ditch side walls. The elevator trough rests on a transverse roller on the main frame, and the trough and the cleaning rotors are jackknifed about a transverse axis by a hydraulic jack connected to the elevator trough and to the main frame. Conveyor flights move debris from the cleaning rotors at the ditch bottom along the elevator trough for discharge onto a transverse conveyor extendable to and discharging from either side of the main frame.

5 Claims, 5 Drawing Sheets

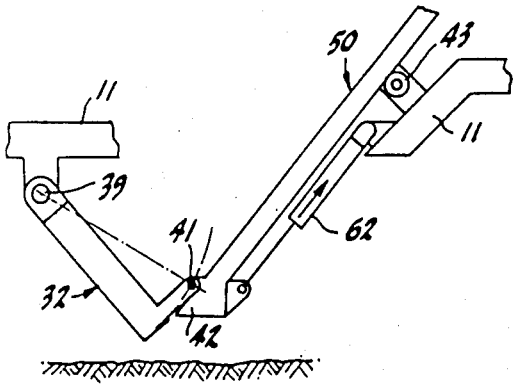
FIG-7
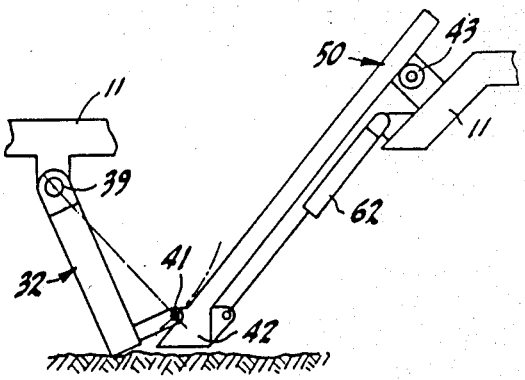
FIG-8
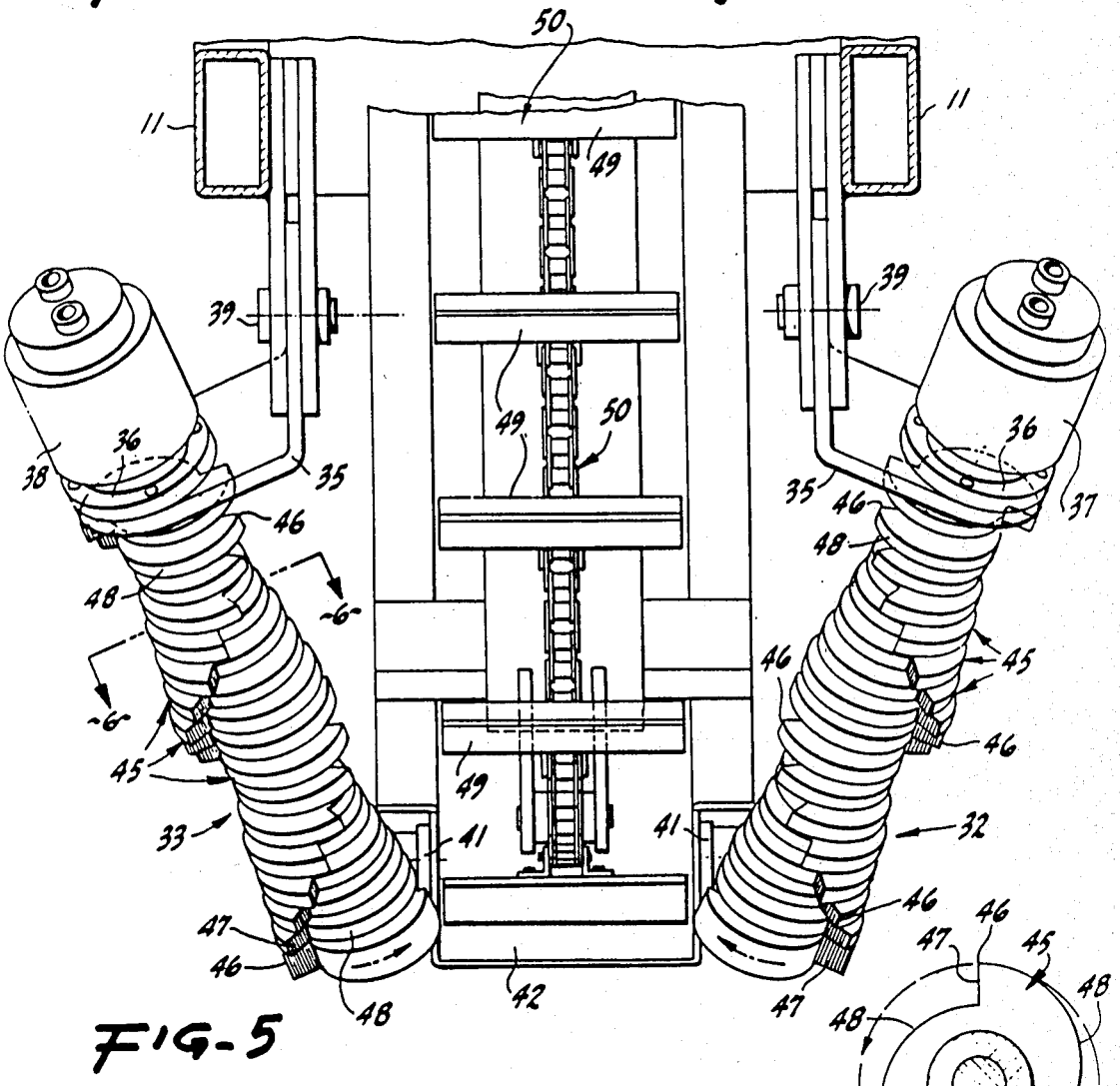
FIG-5
FIG-6

DITCH CLEANING MACHINE

BACKGROUND OF THE INVENTION

1. Field Of The Invention

The invention concerns power-driven devices used in removing or stripping debris and growth out of a ditch in the earth and depositing the stripped material or debris elsewhere while establishing a desired contour for the ditch.

2. Description Of The Related Art

The applicant is aware of standard excavating and earth handling machines but has made no extensive investigation in that field and does not know of any devices especially constructed to be ditch cleaning machines coming within the terms of the claims herein.

SUMMARY OF THE INVENTION

A ditch cleaning machine has a main frame resting on front and rear steerable driven wheels adapted to run on the bottom of the ditch. A pair of outriggers maintains the machine upright. The wheels and other movable parts of the machine are hydraulically actuated to advance the machine in the ditch or along the ditch. A pair of inclined cleaning rotors conforms to the slant of the cleaned ditch sides and discharges in front of an elevator. An elevator trough extending lengthwise of the machine and slanting upwardly and rearwardly from the bottom of the ditch includes a longitudinal conveyor carrying material discharged from the cleaning rotors to fall at an elevated rear end onto a transverse conveyor arranged to discharge at either side of the machine. The cleaning rotors and the elevator trough are mounted on the frame and are connected together in such a way as to jackknife about transverse axes, to vary the depth of ditch cleaning.

BRIEF DESCRIPTION OF THE DRAWINGS

FIG. 5 is an enlarged view on a transverse vertical plane, as indicated by the line 5—5 of FIG. 1, of the ditch cleaning rotors and some associated structure.

FIG. 6 is a cross-section through one of the rotors, the section being on a plane indicated by the line 6—6 of FIG. 5.

FIG. 7 is a diagram showing in side elevation the principal linkage of the machine in a raised position.

FIG. 8 is a view like FIG. 7, showing the linkage in a lower position.

DESCRIPTION OF THE PREFERRED EMBODIMENT

Figures 1, 4:
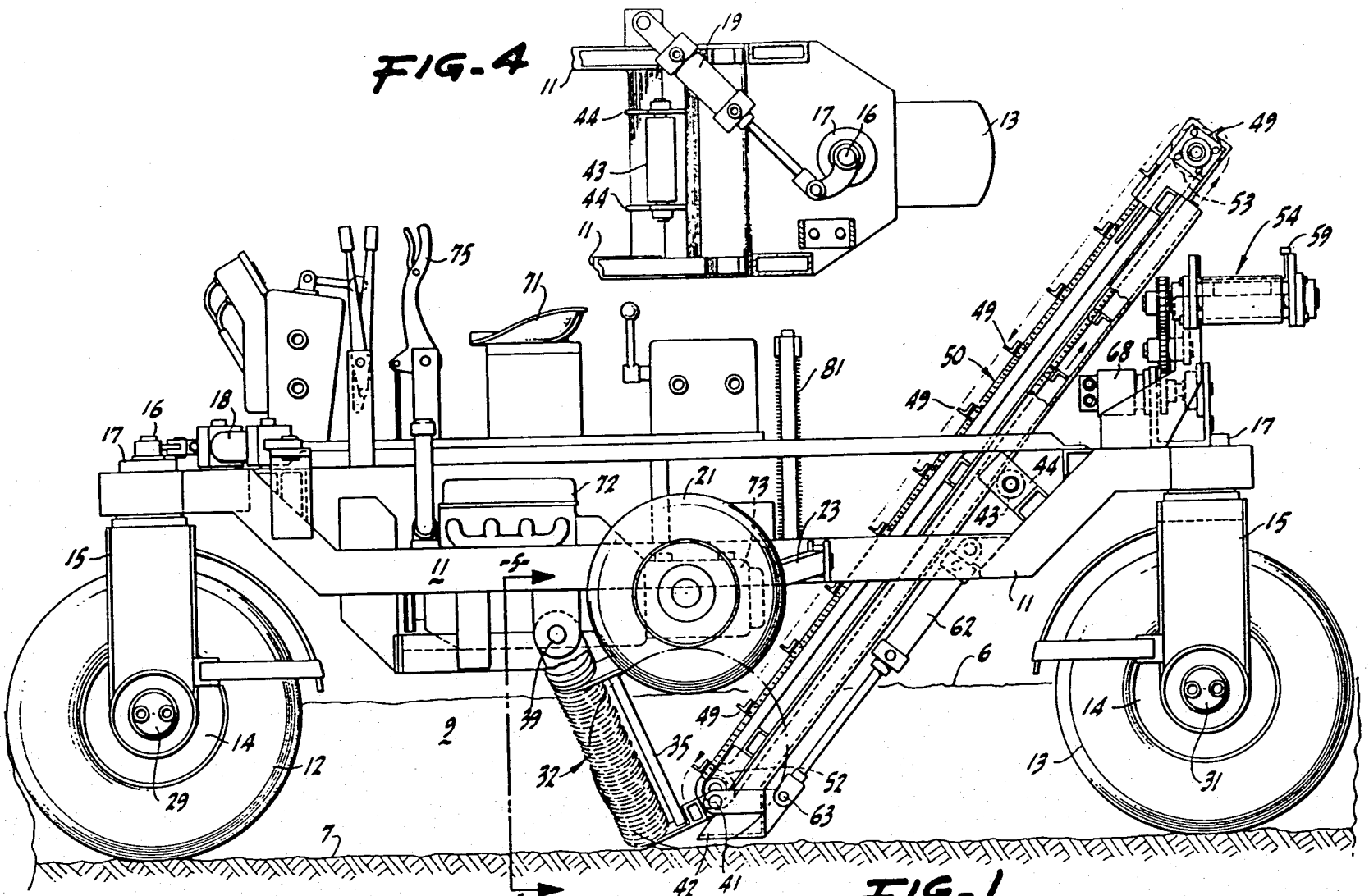
FIG. 1 is a side elevation of a ditch cleaning machine pursuant to the invention and disposed in a typical ditch. The ditch is shown in cross-section on a vertical longitudinal plane. Hydraulic hoses of the machine are removed.
FIG. 4 is a cross-section as indicated by the line 4—4 of FIG. 3.

In a typical work environment, there is a relatively level earth surface 6 in which there has already been provided a ditch of generally trapezoidal cross-section in a transverse vertical plane. The ditch is defined by a bottom surface 7 which is substantially flat or horizontal and a pair of straight, facing side surfaces 8 and 9 inclined outwardly toward an open top. The ditch when new is preferably close to a precise geometrical configuration, although after some service the ditch cross-section changes by earth slumping, ingrowth by crops or the like, or weeds. Also, the ditch may be subject to deterioration perhaps by animal action, such as gopher or mole depredation, so that its cross-section does not retain its initial trapezoidal form. It is important to restore the ditch to its original shape and also to remove from it various ingrowths or discontinuities so that water flow, which usually is at a relatively slow rate, can be maintained at its originally intended volume and flow pattern.

To be driven in and along the ditch by an appropriate operator, there is provided a machine having a main frame 11 made up of metal shapes and members appropriately welded together and extending longitudinally of the ditch to rest on a forward tire 12 and on a rearward tire 13. Each of these tires is on a respective offset wheel 14 rotatably mounted on a supporting yoke 15 having a spindle 16 rotatable about a vertical axis. Each spindle has a journal 17 and is operated about the vertical axis by a hydraulic cylinder 18 or jack in front and a similar hydraulic cylinder 19 or jack in back.

The frame is laterally stabilized and additionally supported by an outrigger wheel 21 on one side and an outrigger wheel 22 on the other side. Each outrigger wheel is mounted at the extremity of its own parallelogram support including a bottom yoke 23 augmented by a top strut 24. The parallelogram connections are by parallel pivot pins collectively designated 26. The relative position of the parallel links is established on one side by a hydraulic jack 27 and on the other side by a hydraulic jack 28. Preferably the jacks are individually operated to take into account terrain on one side uneven as compared to terrain on the other side. The jacks can be simultaneously controlled if desired. The range of lifting and lowering motion of the lateral parallelogram wheel supports is such that the machine can be operated with all four wheels in a diamond pattern on the level surface of the ground or can be operated with the front and rear wheels down into the ditch and the outrigger wheels on the ground at either side of the ditch. The machine is stable in those conditions. The machine can appropriately be raised out of the ditch by using the jacks 27 and 28.

While the outrigger wheels 21 and 22 preferably are not driven, the tires 12 and 13 operating in the ditch are each driven. A hydraulic motor 29 for the front wheel and a similar motor 31 for the rear wheel are usually operated, simultaneously, although each one can be operated alone if desired.

To serve as the actual ditch cleaning tools, there are provided cleaning rotors 32 and 33 designed to rotate about axes that are inclined downwardly and rearwardly and that are parallel to the inclined side surfaces 8 and 9 of the ditch. The rotors extend from near the bottom 7 of the ditch to well above the ground surface 6. Each rotor is mounted in a journal 34 at the bottom of a bracket 35 and in a journal 36 at the top of the bracket. Each rotor 32 and 33 is propelled by its own one of a pair of hydraulic motors 37 and 38. The top brackets 35 are connected at the top to the frame 11 by pivot pins 39 disposed on a common transverse axis. They are connected at the bottom by pivot pins 41 having a common, parallel transverse axis and supported on an elevator trough 42 acting as a frame. The trough extends upwardly and rearwardly and is partly supported by or rests on a roller 43 supported on a frame bracket 44 for rotation relative to the frame.

Each of the cleaning rotors 32 and 33 is made up of a superposed series of individual discs 45 of eccentric, double crescent formation having a leading cutting corner 46 defined by a radial face 47 and a spiral, peripheral face 48. The discs are arranged axially in any desired order or in a multiple pattern. When the rotors are operated they tend to strip projecting or intrusive materials from the sides of the ditch and to move materials downwardly partly by power and partly by gravity to collect in front of the elevator trough 42.

A number of transverse flights 49 are on an elevating conveyor 50 driven by a motor 51. The chain of the conveyor 50 operates around sprockets 52 and 53 centrally of the elevator trough. The flights engage the material dislodged by the rotors and convey that material upwardly in the trough to discharge over the upper end thereof. Such discharged material falls onto a cross conveyor 54 in a frame 56 held in any desired transverse position in a transverse carrier frame 57. For over-land or road transport, the cross conveyor 54 is usually centered but can be arranged on the job site to project on either side beyond the extent of the respective outrigger wheel. The cross conveyor is secured in position by clamps 58 having lips 59 extending over the upper edge of the cross conveyor frame and secured in position by manually tightened screw levers 61.

Material is stripped from the sides of the ditch by the rotors and is carried away. Material is also stripped from the ditch bottom by the bottom leading edge of the elevator trough 42. The trough is moved to and is held in adjusted position by a hydraulic jack or cylinder 62 acting through a pin connector 63 on the bottom of the trough. Drive of the cross conveyor in any position is by a chain 64 extending over a pair of sprockets 66 and a drive sprocket 67, itself on the shaft of a hydraulic drive motor 68.

Figure 2:
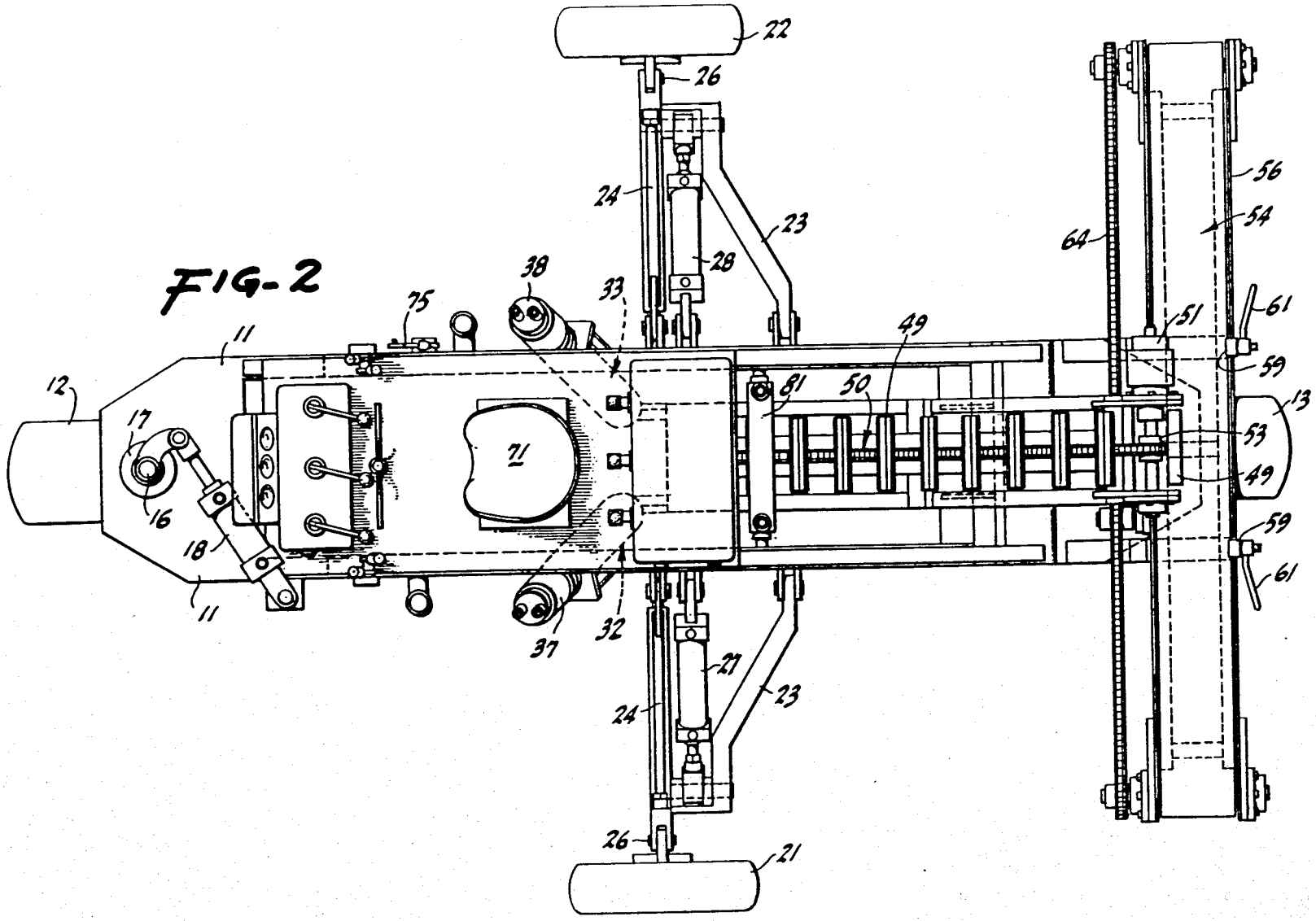
FIG. 2 is a plan of the machine shown in FIG. 1.
Figure 3:
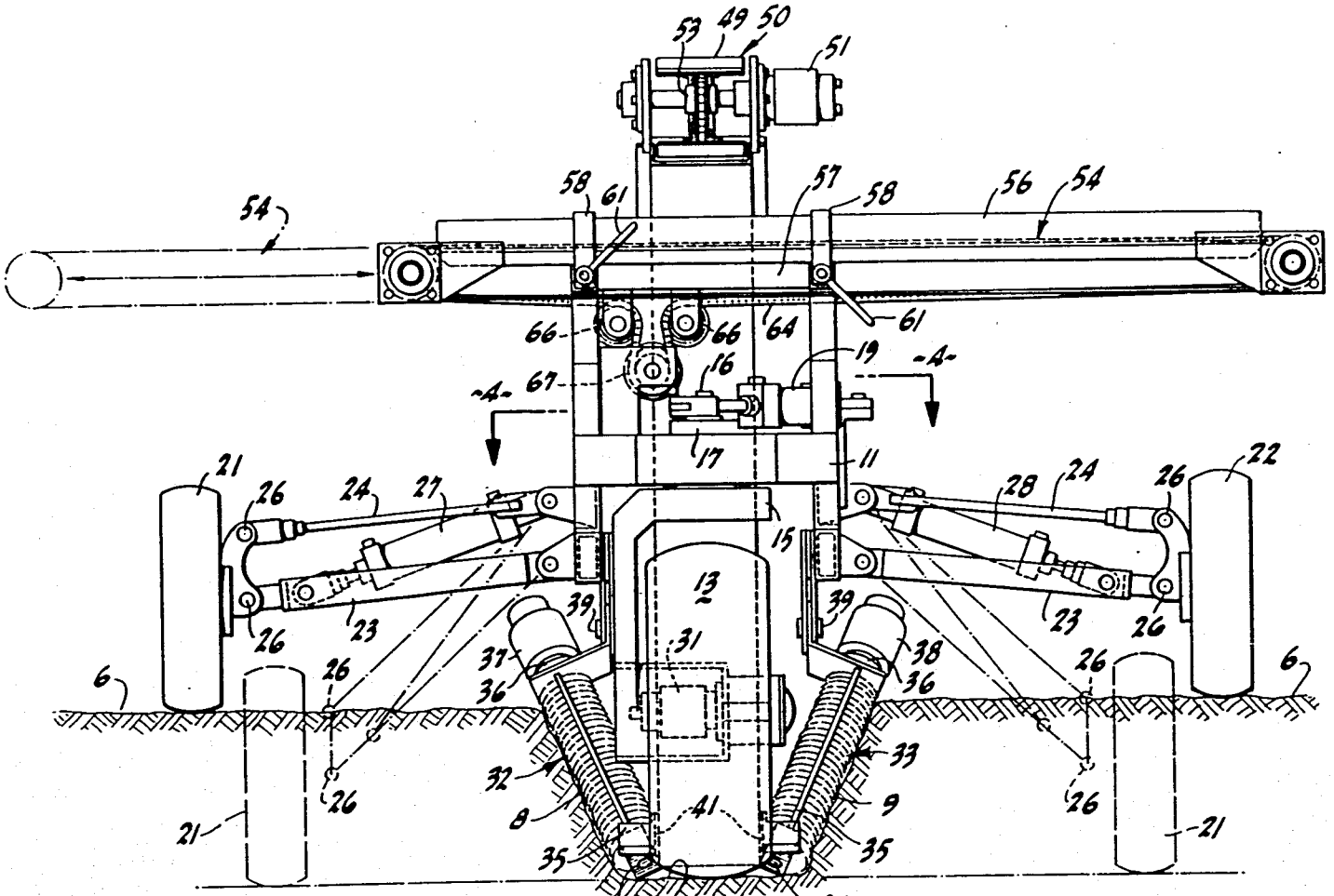
FIG. 3 is a rear elevational view of the ditch digging machine and particularly showing the ditch and its surroundings in cross-section on a vertical transverse plane.
Figure 9:
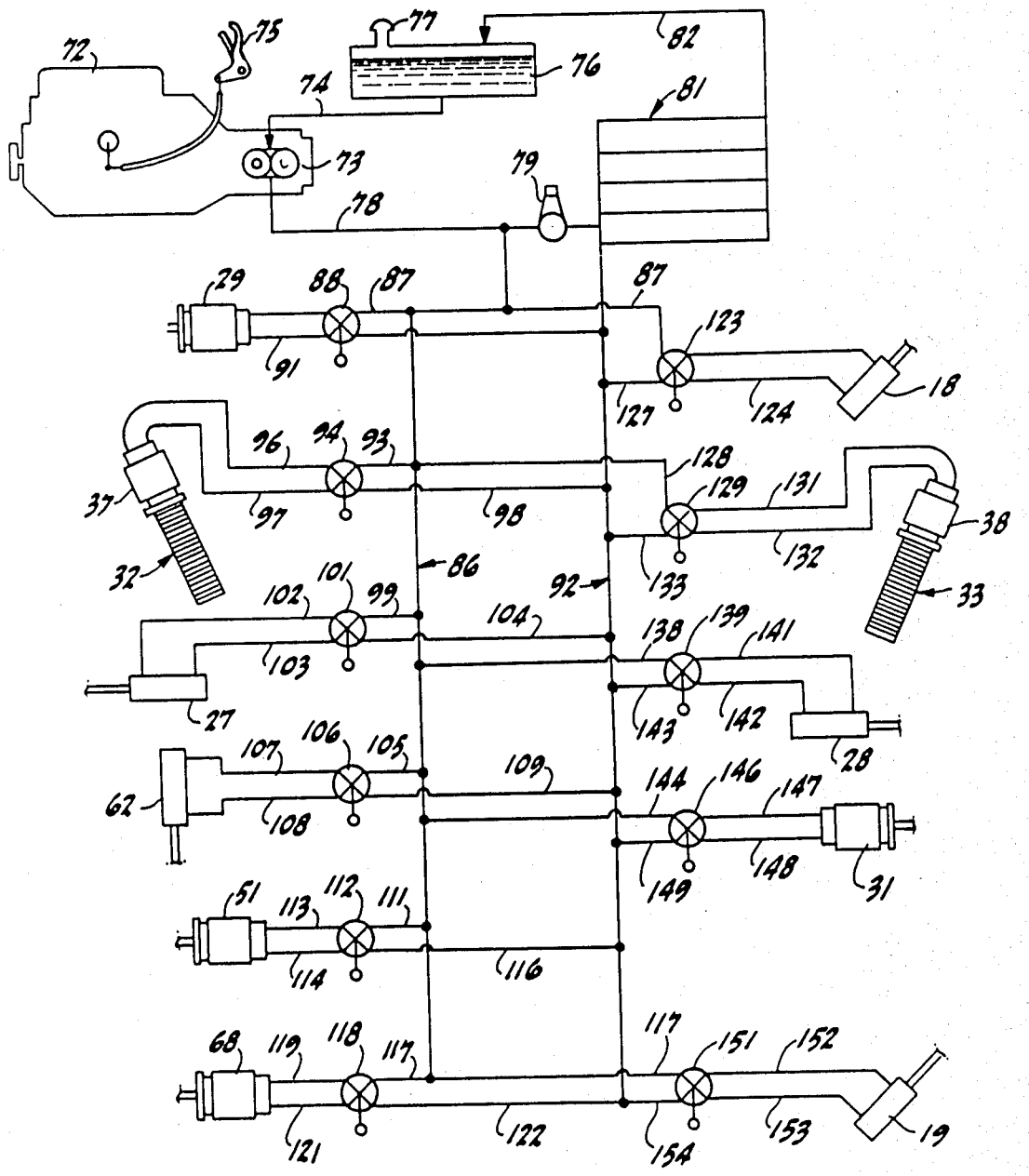
FIG. 9 is a diagram showing the hydraulic circuitry of the machine.

The vehicle operator is provided with a seat 71 on the top of the frame adjacent various controls shown in FIGS. 1 and 2 and detailed in FIG. 9. Power is derived from an internal combustion engine 72 mounted on the frame 11 and driving a hydraulic pump 73 effective through the circuitry and valving shown in FIG. 9 to operate all of the functional parts of the machine. A hand lever 75 controls the engine.

The pump 73, through an inlet duct 74, derives hydraulic fluid from a tank 76, open to the atmosphere through a filler vent 77, and discharges through a duct 78 and through a pressure regulator valve 79 into an oil cooler 81. A discharge line 82 goes from the cooler back to the tank 76. The regulated pressure in the line 78 extends to a manifold 86 having a branch 87 going through a standard, multi-position hand-controlled valve 88 to a drive motor 29 on the front wheel. The return from the motor 29 and the valve 88 is through a line 91 to a return manifold 92 connected to the inter cooler 81. The manifold 86 is connected to a line 93 controlled by a similar hand-operated valve 94 leading through a duct 96 to the drive motor 37 of the left-hand rotor 32 and has a return line 97 going back through the valve 94 and a duct 98 to the manifold 92. Comparably, from the manifold 86 extends a line 99 controlled by a similar valve 101 joined by a line 102 to the outrigger jack 27, return being through a line 103, the valve 101 and a line 104 to the manifold 92.

A pressure line 105 goes through a similar hand-controlled valve 106 and a line 107 into the elevator jack 62, a return line 108 leading back through the valve 106 and a line 109 to the return manifold 92. The rear elevator drive motor 51 is supplied from the pressure manifold 86 through a connector line 111 and a valve 112 and a duct 113 and discharges through a line 114 and the valve 112 and a connector 116 to the low pressure manifold 92. In a comparable fashion, a line 117 from the manifold 86 goes through a manually controlled valve 118 and a line 119 to the cross conveyor drive motor 68. Return flow from the motor 68 is through a duct 121 and the valve 118 to a line 122 connected to the manifold 92.

On the other side of the circuitry, the pressure in the line 87 is available through a manually controlled valve 123 to the front steering jack 18. Backflow from the jack is through a connecting line 124 and the valve 123 as well as a junction line 127 to the manifold 92. The right motor 38 is operated by pressure through a junction line 128 and a manually controlled valve 129 as well as a connecting duct 131 to the motor 38, from which return is through a line 132 and the valve 129 and a junction line 133 to the manifold 92. The right outrigger jack 28 is supplied with pressure fluid from a line 138 and a manually controlled valve 139 as well as a duct 141, return being through a duct 142 and the valve 139 to a junction 143 connected to the manifold 92.

Power for the rear drive motor 31 is supplied from the pressure line 86 through a connector 144 and a manually controlled, multi-port valve 146 to a line 147 extending to the rear drive motor, return from which is through a line 148 and the valve 146 and a line 149 to the manifold 92. The rear steering jack 19 receives pressure fluid through the line 117 and a valve 151 and a connecting line 152. Discharge goes through a connecting line 153 and the valve 151 to a line 154 joined to the return manifold 92. While many of these controls can be combined if desired; for example, the controls 94 and 129 or 123 and 151, it is for explanatory purposes and sometimes in actual operation preferable to afford an individual control for each element so that the operator has maximum discrete control over the functioning of the device.

With all the structures operating, the seated operator can advance the machine in the direction of the ditch, propelling it with the drives of the front and rear wheels. The machine strips the sides of the ditch by means of the driven rotors and lifts the detached debris from the sides and bottom of the ditch through the trough as impelled by the discharge conveyor and deposits the loose material on the ground from either end of the properly positioned transverse conveyor. In this way, short lengths or long extents of irrigation or drainage ditches can be maintained in substantially growth-free or weed-free condition for maximum functioning.

In the usual use of the device, it is parked with the valves 101 and 139 to the jacks 27 and 28 closed so that the outrigger wheels 21 and 22 are held on the ground 6. The machine is thus stably supported on all four wheels. To get the machine under way, the operator occupies his seat 71 and starts the engine 72, setting the throttle 75 at the desired point so that the oil pump 73 furnishes the desired supply of oil under pressure. By working the valves 88 and 146, the operator supplies oil to one or both of the wheel motors 29 and 31 and drives off, regulating the steering by supplying pressure oil to one or both steering jacks 18 and 19 through the valves 123 and 151. Travelling over substantially level ground to the work site, the outrigger wheels are disposed to straddle the ditch with the main frame 11 extending along the ditch. Then the valves 101 and 139 for the outrigger jacks 27 and 28 are operated to lower the main frame 11 and so dispose the tires 12 and 13 in the ditch, one behind the other. The valves 94 and 129 are actuated to drive the rotor motors 37 and 38 as the main frame continues forward. The conveyor motor 51 is supplied with oil, as is the conveyor motor 68. From time to time as the machine advances, the valve 106 may be manipulated to control the jack 62 and so to jackknife the rotors 32 and 33 and the conveyor trough 42 relative to each other and to the frame 11, thus lifting and lowering the leading edge of the trough 42 to maintain the desired level of the ditch bottom 7 despite some variations in the elevations of the ground along either side of the ditch. When debris is about to discharge from the upper end of the trough 42, the transverse conveyor motor 68 is started by operation of the valve 118. This operation is continued indefinitely, the driving of the steering motors being adjusted for operation from time to time depending upon the ditch contour and length. At the conclusion of the cleaning operation, the valves 101 and 139 are operated to actuate the outrigger jacks 27 and 28 and so lift the main frame 11 and lift the tires 12 and 13 out of the ditch. The machine can be advanced (or reversed) to a parking place and shut down by substantially an opposite sequence of the starting routine.

What is claimed is:

1. A ditch cleaning machine comprising a main frame extending longitudinally along an axis, a front ground-engaging wheel connected to the front of said main frame for pivoting about a first vertical axis, a rear ground-engaging wheel connected to the rear of said main frame for pivoting about a second vertical axis, a first outrigger wheel disposed on one side of said axis, a second outrigger wheel disposed on the other side of said axis, means for mounting said outrigger wheels on said main frame in transverse alignment and for vertical swinging movement relative to said main frame, a support roller, means for mounting said support roller on said frame for rotation about a transverse axis, an elevator frame extending longitudinally and resting on said roller, a pair of cleaning drum carriers, means for mounting both of said carriers at the top thereof for pivotal movement on said frame, cleaning drums rotatably mounted on said carriers, means for connecting both of said cleaning drum carriers at the bottom thereof to the lower end of said elevator frame for pivotal movement about a transverse axis, a jack pivoted to said frame and to said elevator frame for jackknifing both of said cleaning drum carriers with respect to said elevator frame, an elevator mounted on said elevator frame, a discharge conveyor frame, means for mounting said discharge conveyor frame for transverse shifting movement on said main frame, and a transverse conveyor mounted on said discharge conveyor frame.

2. A ditch cleaner for use with a ditch comprising a main frame, means for supporting said main frame to extend along and to straddle said ditch, means for conveying material from the bottom of said ditch to a higher point on either side of the ditch, and means for dislodging material from both sides of said ditch said main frame having two parallel side rails, a material discharge conveyor having two sides and disposed between said rails, a roller extending across and journalled on said side rails, a pair of transversely spaced links each pivoted at one end to one of said side rails and at the other end to a respective one of said sides of said discharge conveyor, and means interconnecting said main frame and said discharge conveyor for rolling said discharge conveyor on said roller.

3. A device as in claim 2 including means interconnecting said main frame and said supporting means for varying the vertical distance between said means for conveying material and said main frame.

4. A device as in claim 2 including a material discharge conveyor, a pair of means for carrying excavating rotors, means for pivotally connecting one end of said discharge conveyor to one end of both of said carrying means, means for connecting the other end of said carrying means to said main frame, excavating rotors on said carrying means, and means interconnecting said main frame and said discharge conveyor for supporting said discharge conveyor in any of several positions on said main frame.

5. A device as in claim 2 including means for carrying an excavating rotor, means for mounting said carrying means on said frame for swinging movement in said direction along said ditch, means for holding said carrying means in a selected position of said swinging movement, an excavating rotor mounted on said swinging means for rotation about a predetermined axis relative to said swinging means, and means for rotating said rotor about said predetermined axis.

* * * * *